US006869199B1

(12) United States Patent
Burnidge

(10) Patent No.: US 6,869,199 B1
(45) Date of Patent: Mar. 22, 2005

(54) ILLUMINATED HOLIDAY TREAT CARRIER

(76) Inventor: Lane E. Burnidge, 5N916 Sunset St., Maple Park, IL (US) 60151

( * ) Notice: Subject to any disclaimer, the term of this patent is extended or adjusted under 35 U.S.C. 154(b) by 0 days.

(21) Appl. No.: 10/738,480

(22) Filed: Dec. 17, 2003

Related U.S. Application Data

(63) Continuation of application No. 09/875,822, filed on Jun. 6, 2001, now abandoned.

(51) Int. Cl.[7] ..... F21V 33/00

(52) U.S. Cl. ..... 362/155; 362/109; 362/251; 362/806

(58) Field of Search ..... 362/154, 155, 362/156, 109, 191, 577, 101, 562, 251, 252, 806, 800, 809

(56) References Cited

U.S. PATENT DOCUMENTS 5,984,754 A * 11/1999 Freelander ..... 446/73
6,152,572 A * 11/2000 Cutler ..... 362/155
6,200,000 B1 * 3/2001 Burnidge ..... 362/155

* cited by examiner

*Primary Examiner*—Thomas M. Sember
*Assistant Examiner*—Bao Q. Truong
(74) *Attorney, Agent, or Firm*—William C. Grabarek

(57) ABSTRACT

An improved illuminated carrier for articles, such as Halloween and other holiday treats, which is nestable and allows for ease of transport, warehousing and assembly.

2 Claims, 2 Drawing Sheets

ILLUMINATED HOLIDAY TREAT CARRIER

This is a continuation of application Ser. No. 09/875,822, filed Jun. 6, 2001, now abandoned.

BACKGROUND OF THE INVENTION

1. Field of the Invention

The present invention relates to an improved illuminated carrier for articles such as Halloween and other holiday treats.

2. Description of Related Art

Typically, the tradition of trick or treating at Halloween is done at dusk and into the night when the danger to a child not being seen by approaching motor vehicles is greatest. To minimize this danger, the child is often required to carry a flashlight or a battery-powered lantern to warn drivers of motor vehicles of the child's presence. For younger children, this method is cumbersome, as the child is required to carry both a container for carrying the collected treats and a flashlight or lantern and the degree of safety for the child is thereby diminished. Additionally, novel carriers are generally sought by children and their parents, especially those that provide safety features, such as illumination. The costs associated with the assembly of such carriers, however, is high, therefore lower assembly costs are desirable. Additionally, bulk shipping and warehousing costs per unit of the finished carrier is generally substantial due to the prior art carriers being of a fanciful or other such shape which cannot be nested or stacked within each other.

While various treat-carrying jack-o-lanterns and the like have been developed in the past to overcome the shortcomings of carrying both a flashlight or battery-powered lantern and a trick or treat bag or container, their commercial success has been limited.

U.S. Pat. Nos. 4,698,732 and 4,714,985, for example, describe carriers for treats and other articles which have either a single or double bottom and which employ a flashlight insert. Further, in both inventions, the light beam is directed downward, thereby providing minimal illumination to motorists.

U.S. Pat. No. 4,802,071 describes a lantern candy carrier which employs a battery-powered light source. Because of its fanciful shape, it is not nestable or stackable thereby increasing transporting and warehousing costs.

U.S. Pat. No. 4,926,296 describes another attempt to provide a battery powered, illuminated carrying bag for transporting articles. While the bag provides some of the economies present in the present invention, it does not provide the omni-directional illumination needed for child safety. Instead, the light only shines through the transparent portion of the front sidewall.

Further, U.S. Pat. No. 5,597,230 describes an ornamental carrier with flashlight-type eyes. This lighting means, like that of the '296 patent above, provides only uni-directional lighting and fails to provide adequate warning of the child's presence to an approaching motor vehicle unless the face of the ornamental carrier is pointed toward the motor vehicle. Additionally, the shape of the carrier does not allow for economical transporting or warehousing.

U.S. Pat. No. 6,200,000 describes an improved illuminated carrier which overcomes many of the shortcomings of the other prior art carriers, but lacks nestability and stackabiity which increases the costs of transporting and warehousing.

Although these prior art treat carriers provide children with varying degrees of safety at night, as well as novelty, the costs of assembly, transportation and warehousing of the finished articles are generally too high. The need for an easily assembled and stackable, less expensive carrier is evident. The present invention overcomes the assembly, transportation and warehousing shortcomings of the prior art carriers by providing a lower cost, nesting or stackable carrier employing readily available, translucent plastic containers with a modified snap ring cover. To permit nesting of the containers, their geometry shall be that of an inverted truncated cone or such other shape which would permit them to be stacked one inside the other during shipment and warehousing. At the distribution or sale site, the snap ring covers with their illuminating means can be attached to the top of the container, thus providing the finished product.

BRIEF SUMMARY OF THE INVENTION

It is a general object of the present invention to provide an improved, lower cost, illuminated container and snap ring cover having an opening in the cover sufficient for the insertion and removal of articles such as Halloween or other holiday treats. The circuitry of the illuminating means is more fully described in U.S. Pat. No. 6,200,000, which circuitry is secured around the underside of the cover. It is a more particular object of the present invention to provide an improved, lower cost, illuminated carrier which is more economical to transport and warehouse.

BRIEF DESCRIPTION OF THE DRAWINGS

The accompanying drawings, which are incorporated into and constitute part of this specification, illustrate a preferred embodiment of the invention, and together with the detailed description below, serve to explain the invention in greater detail.

DETAILED DESCRIPTION OF THE INVENTION

The following description is provided to enable one skilled in the art to make and use the invention and sets forth the best mode of the invention. Variations of the invention will be readily apparent to those skilled in the art.

Figure 1:
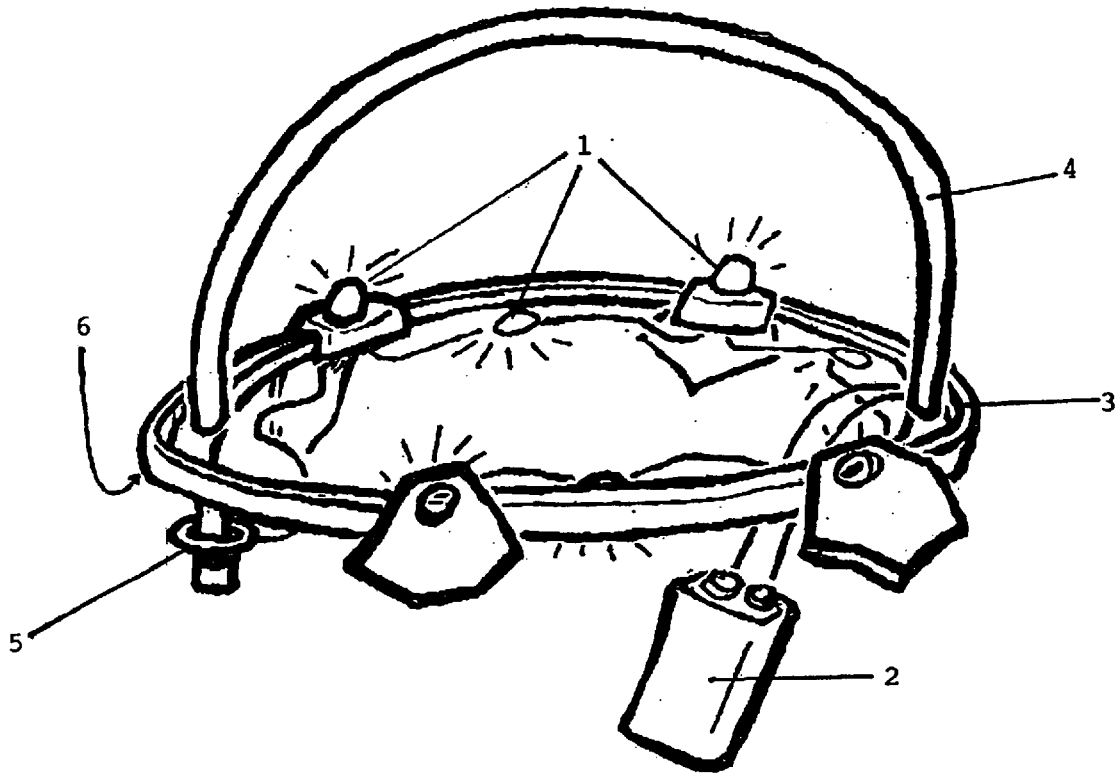
FIG. 1. is a perspective view of a snap ring cover having a lift actuated electrical switch in conjoint use with the carrying handle, dry cell battery and light emitting means embellished with optional decorative leaf shaped tabs.

In FIG. 1, a plurality of light emitting means 1, are wired in a parallel or series circuit with a dry cell battery 2, and mounted on the underside of a snap ring cover of rigid or semi-rigid, and preferably, translucent plastic 3 and to which one end of a rigid or semi-rigid plastic handle 4 is mounted on the upper surface of the snap ring cover and the other end of the handle is inserted through an opening in the upper surface of the snap ring directly opposite of the mounted end of the handle, said handle end having an electrical conducting material or contact 5 attached to and around the free end of the handle and to which the wire forming one side of the electrical circuit is attached.

An opening of sufficient diameter should be provided to allow the free end of the handle to be inserted through and slide within the opening without binding. The free end of the handle should be of such length to protrude through such opening and extend below the underside of the snap ring cover a sufficient distance to allow the electrical circuit to be broken when there is no lifting of the handle. Between the underside of the snap ring cover and the terminus of the free end of the handle on which the electrical conducting material or contact is attached is a circular shaped metal contact 6 (not seen) fastened to the underside of the snap ring cover and having an opening through which the handle is inserted. This metal contact 6 is attached to one end of the electrical wire forming the other end of the circuit to which the contact end of the handle is attached. The opening in the circular portion of this metal contact should be of sufficient diameter to allow the free end of the handle to slide within it without binding when the hollow plastic container, around which the snap ring cover has been attached and secured, is lifted by the handle, yet should have an inside diameter which is smaller than the outside diameter of the electrical conducting material or contact 5 attached to the free end of the handle to prevent the free end of the handle from passing through the inside diameter of metal contact 6. When the snap ring cover has been secured on the hollow plastic container and the container is lifted by the handle, the weight of the container causes the electrical contacts 5 and 6 to touch completing the electrical circuit and powering the light emitting diodes or incandescent lamps thereby illuminating the rim of the snap ring cover and inside walls of the container.

Figure 2:
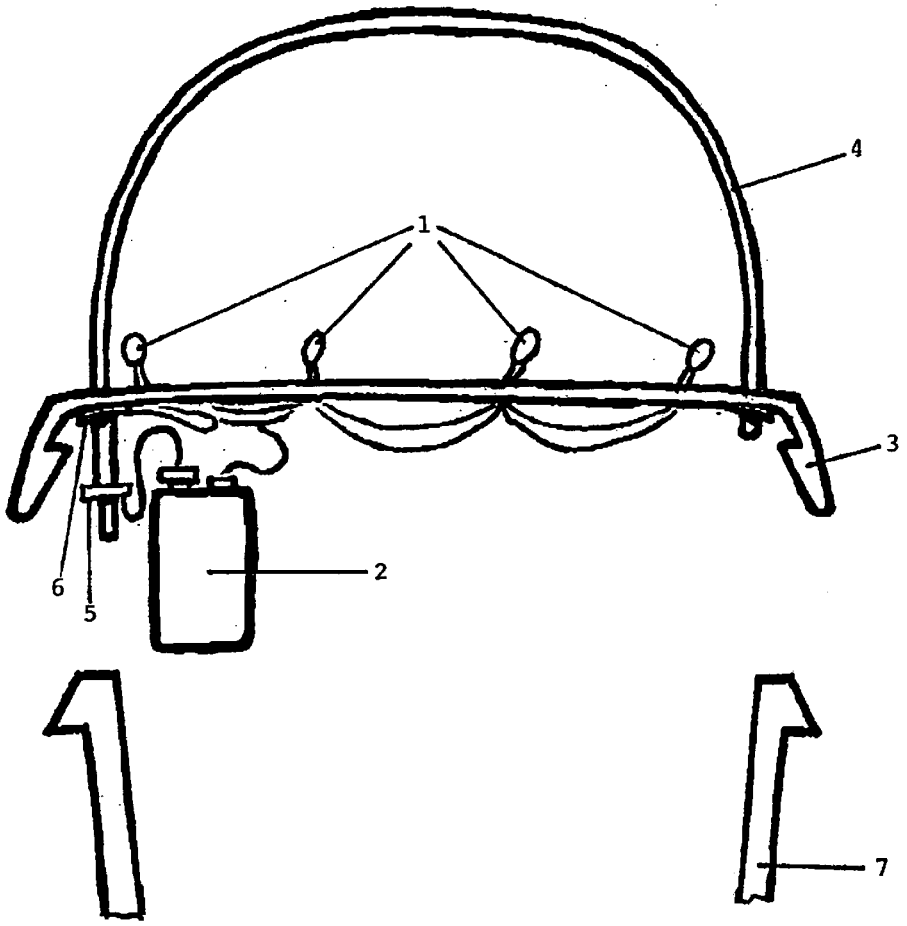
FIG. 2 is a sectional view of a snap ring cover, lift actuated electrical switch in conjoint use with the carrying handle, dry cell battery and light emitting means.

FIG. 2 illustrates a cross sectional view of the snap ring cover 3 and the various components of FIG. 1 and a fragmentary cross sectional view of the container 7.

Figure 3:
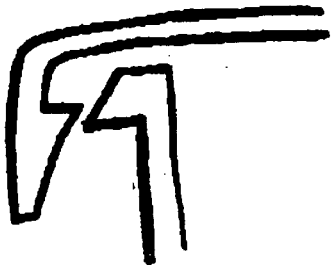
FIG. 3 is a fragmentary sectional view of the outer edge of a snap ring cover and upper edge of the carrier body.

FIG. 3 illustrates, in greater detail, one type of molded protrusion around the outer upper edge of the container and around the inner edge of the snap ring cover.

The snap ring cover with the illuminating means is secured to the top of the outside wall of the hollow plastic container by pushing the snap ring cover over the protrusions of the container, which step can be easily accomplished at the final distribution or sale site, thus allowing economy of transportation and warehousing costs. Other means of attaching the illuminating cover of the present invention to the container can be employed with equivalent success, such as securing the cover within the container by molding a groove in the upper inner wall of the container into which the cover is secured. Such alternate securing means will be readily apparent to those skilled in the art.

The choice of electrical circuitry, whether parallel or series; the choice of the size and number of light emitting diodes, incandescent lamps or other lighting means, whether flashing or not, along their respective voltage requirements; for the light emitting means is determinative of the size and number of dry cell batteries desired to be employed. For economy of battery life and intensity of illumination, light emitting diodes are preferred. When light emitting diodes are used alone or in combination with a solid state electronic circuit flashing device, a nine volt dry cell battery is preferred as the power source.

While the above drawings describe one embodiment of the invention, other variations are contemplated to be within its scope, including employment of a carrying handle attached to the container instead of the cover, as well as a non-switch handle mounted on the cover. Such non-switch handle variations may or may not require a switch located elsewhere on the cover or container.

The various aspects of the invention provide a novel concept for a lower cost carrier for articles such as Halloween treats and the like and provides for increased safety for children from the danger of not being seen by approaching motor vehicles, as well as economy of transport and warehousing of the product.

While the present invention has been illustrated by the description of the preferred embodiments, it is not the intention of the applicant to in any way limit the scope of the appended claims. Additional modifications and advantages will be readily apparent to one skilled in the art. Therefore, the invention's scope is not to be limited to the specific described embodiments.

What is claimed:

1. An illuminated carrier for articles, said carrier comprising:

A nestable container wherein said container has a molded protrusion around the outer upper edge of said container;

A cover for said container, said cover having:

A molded protrusion around the inner lower edge of said cover, the inner diameter of said protrusion of said cover being of a diameter larger than the inner diameter of said protrusion of said container, but smaller than the outer diameter of said protrusion of said container;

An opening through the upper top portion of said cover;

One or more light emitting means mounted on said cover and around and inside the outer edge thereof, said light emitting means being in circuit with a power source;

A switch means connected to said power source for actuating said light emitting means; and A handle means.

2. The container and cover of claim 1 wherein said container and cover are translucent plastic.

* * * * *